US005441663A

United States Patent [19]

Subramanyam et al.

[11] Patent Number: 5,441,663

[45] Date of Patent: Aug. 15, 1995

[54] COMPOSITION

[75] Inventors: Ravi Subramanyam, North Brunswick; Ben Gu, East Brunswick; AnBen Hwang, Verona, all of N.J.

[73] Assignee: Colgate-Palmolive Co., Piscataway, N.J.

[21] Appl. No.: 172,621

[22] Filed: Dec. 20, 1993

[51] Int. Cl.[6] ..... C11D 9/32; C11D 9/22

[52] U.S. Cl. ..... 252/108; 252/117; 252/121; 252/132; 252/DIG. 16; 252/DIG. 11; 252/397

[58] Field of Search ..... 252/18, 117, 121, 132, 252/DIG. 16, DIG. 11, 397

[56] References Cited

U.S. PATENT DOCUMENTS

| | | | |
|---|---|---|---|
| 4,758,370 | 7/1988 | Jungermann et al. | 252/108 |
| 4,919,838 | 4/1990 | Tibbetts et al. | 252/108 |
| 5,284,598 | 2/1994 | Subramanyam et al. | 252/108 |
| 5,294,363 | 3/1994 | Schwartz et al. | 252/108 |

*Primary Examiner*—Paul Lieberman
*Assistant Examiner*—Patricia Hailey
*Attorney, Agent, or Firm*—Martin Barancik; Robert C. Sullivan

[57] ABSTRACT

A solid composition comprising a. about 5 to 85 wt % of an acylisethionate salt, b. about 90 to 5 wt % of soap, and c. an effective amount of a metal chelating agent consisting solely of an agent selected from the group consisting of ethylene diamine tetra acetic acid, water soluble salts of said acid, and mixtures thereof, said composition having a pH of from about 7.2 to 10.

10 Claims, No Drawings

COMPOSITION

BACKGROUND OF THE INVENTION

Acyl isethionate salts have been utilized for many years as surfactants in body care compositions. They are generally used in combars or synthetic detergent bars where their increased mildness in relationship to soaps are an advantage. The stability of these compositions under aging conditions such as shelf life have been studied for some time. Various antioxidants have been placed into soap and acyl isethionate compositions in order to provide increased stability under shelf life conditions. Various references are known which discuss the utilization of antioxidants to enhance shelf stability. Some of these antioxidants are known free radical scavengers which stop deterioration causing reactions from occurring. Examples of such antioxidants are butylated hydroxy toluene, (BHT) and butylated hydroxy anisole (BHA). Additionally it is well known that certain metals catalyse reactions which bring about the deterioration of the bar. Examples of such metals include iron and copper. Various chelating agents have been utilized to remove the metallic ions from interacting as a catalyst for the deterioration causing reactions. Examples of such materials include ethylene diamine tetra acetic acid (EDTA) or a soluble salt thereof such as a tetrasodium salt. A further chelating agent is 1-hydroxy ethane-1,1-diphosphonic acid (EHDP) or a soluble salt thereof.

It is known to add such agents to acyl isethionate containing personal care compositions to improve their storage properties, for example see UK 1169551 issued to Unilever.

A recent Unilever patent issued by the European Patent Office subject to opposition, EP249474B1, has investigated the shelf stability-deterioration reactions of acyl isethionate further. It has made a study of the usage of the various antioxidants i.e. the 2,6 di-t-butyl-4-hydroxy toluene, previously referred to as BHT, as well as the usage of chelating agents in acyl isethionate containing compositions. At the bottom of page 2 of the published specification is the following paragraph:

> A preferred sequestering agent for copper is ethylene diamine tetra acetic acid (EDTA) or a soluble salt thereof such as its tetra sodium salt or mixtures thereof. Such agents are known to enhance the activities of iron in accelerating autoxidation, however it can be used successfully provided there is a satisfactory sequestering agent for iron present. The two sequestering agents are then acting synergistically.

Therefore even though EDTA is known to be a chelating agent in general for various metallic ions, its use alone in acyl isethionate compositions is cautioned against because it accelerates autoxidation; one of the important reactions which brings about deterioration of a detergent composition and, interalia, a bad odor.

It has now been surprisingly found in view of this statement in EP249474 that EDTA and/or its soluble salts can be utilized successfully in acyl isethionate containing compositions of a certain nature. Thus, the usage of additional chelating agents is unnecessary. The usuage of only EDTA and/or its soluble salts brings about a stable composition.

SUMMARY OF THE INVENTION

In accordance with the invention there is a solid composition comprising:

a. about 5 to 85 wt % of an acyl isethionate salt.
b. about 90 to 5 wt % of soap, and
c. an effective amount of a metal chelating agent consisting solely of an agent selected from the group consisting of ethylene diamine tetra acetic acid, water soluble salts of ethylene diamine tetracetic acid, or mixtures thereof, said composition have a pH of from about 7.2 to 10.

DETAILED DESCRIPTION OF THE INVENTION

Any of the acylisethionate salts normally employed in personal cleansing compositions and laundry detergents can be employed in this composition. Acyl group having unsaturated or preferably saturated groups with normal or branched, preferably normal, groups can be used. Generally, the acyl groups have from about ten to twenty carbon atoms, preferably twelve to eighteen carbon atoms. The acyl group can be mixtures of acyl groups of these carbon lenghts as normally found in naturally products. Examples of such acyl groups are lauryl, cocoyl, plamitoyl and the like. The acyl group from coco fatty acid is preferred. The cation portion of the salt is generally an alkali metal such as sodium or potassium, ammonium, or an alkoxy substituted ammonium such as triethanol amine. Ammonium and sodium are preferred.

Soap is the second necessary component in the composition. Any traditional soap such as a long chain fatty acid salt can be employed.

The quantities of acylisethionate salt and soap which can be employed are from about 5 to 85 wt % acylisethionate salt and 90 to 5 wt % soap as measured by the solid composition. The preferred ranges are those that reflect a combar composition or a syndet composition. For example, in a combar about 6 to 25 wt % acylisethionate salt and 35 to 70 wt % soap is preferred. In a syndet composition about 25 to 60 wt % acylisethionate and 5 to 20 wt % soap is preferred.

The pH of the solid composition is significant. It should be on the basic side of neutral, generally pH of about 7.2 to 10, preferably about 7.2 to 9.5. The pH is measured by making a 1 wt % solution of the composition in water and utilizing a Corning pH meter 120.

It has been surprisingly found that solid cleansing compositions as disclosed above can be sucessfully stabilized against oxidative type metal catalyzed reactions which bring about undesirable odors to the composition by the addition of only a single type of chelating agent-ethylene diamine tetracetic acid (EDTA) and/or any of of its water soluble salts or mixtures thereof. Examples of such water soluble salts are the tri and tetra alkali metal salts such as sodium ethylene diamine triacetate or sodium ethylene diamine tetraacetate.

The quantities of the chelating agents are not unduly significant. Any quantity of agent which successfully removes metal ions, particularly iron and copper, from catalyzing undesirable odor causing reaction(s) can be employed. Generally above about 0.002 wt % of the bar composition can be employed, preferably above about 0.02 wt %. Although not critical, quantities above about 0.5 wt %, preferably above about 0.3 wt % should not be employed primarily because of economics.

The EDTA and/or its water soluble salts successfully remove cations, particularly iron and copper from participation in reactions, particularly those of an odor causing nature, thereby enhancing shelf stability of a solid personal cleaning composition of the nature described.

Various other additives can also be present in such composition but are not required. Examples of such materials are fragrances, colorants, antibacterials, additional surfactants such as nonionic, zwitterionics, amphoterics, and the like. Free fatty acids can also be present for among other purposes, lather performances and skin feel. Of course, further stabilizing materials such as an antioxidant, for example butylated hydroxy toluene, (BHT) are preferably present in the composition for enhanced stabilization. Quantities of BHT can vary from about 20 ppm to 400 ppm of the composition.

We claim:

1. A solid composition consisting essentially of
   a. about 25 to 60 wt % of an acyl isethionate salt,
   b. about 35 to 70 wt % of a long chain fatty acid salt, and
   c. free fatty acid in an amount sufficient to increase lather performance and skin feel,
   d. an effective amount of a metal chelating agent consisting solely of an agent selected from the group consisting of ethylene diamine tetra acetic acid, water soluble salts of said acid, and mixtures thereof, said composition having a pH of from about 7.2 to 10.

2. The composition in accordance with claim 1 wherein a is about 6 to 25 wt % and b is about 35–70 wt %.

3. The composition in accordance with claim 1 wherein a is about 25 to 60 wt % and b is about 5 to 20 wt %.

4. The composition in accordance with claim 1 wherein c is ethylene diamine tetra acetic acid.

5. The composition in accordance with claim 1 wherein c is a water soluble salt of ethylene diamine tetra acetic acid.

6. The composition in accordance with claim 1 wherein c is a mixture of ethylene diamine tetracetic acid and at least one of its water soluble salts.

7. The composition in accordance with claim 1 wherein c is a mixture of water soluble salts of ethylene diamine tetra acetic acid.

8. The composition in accordance with claim 1 wherein the pH of said composition is from about 7.5 to 9.5.

9. The composition in accordance with claim 1 wherein an antioxidant effective amount of an antioxidant is present.

10. The composition in accordance with claim 9 wherein the antioxidant is 2,6-di-t-butyl-4-hydroxy toluene.

* * * * *